US011482110B2

(12) United States Patent
Salles et al.

(10) Patent No.: US 11,482,110 B2
(45) Date of Patent: Oct. 25, 2022

(54) SYSTEMS AND METHODS FOR DETERMINING ACTUAL OPERATING CONDITIONS OF FLEET CARS

(71) Applicant: Toyota Motor North America, Inc., Plano, TX (US)

(72) Inventors: Felipe G. Salles, Garland, TX (US); Joshua V. Marasigan, Carrollton, TX (US)

(73) Assignee: Toyota Motor North America, Inc., Plano, TX (US)

( * ) Notice: Subject to any disclaimer, the term of this patent is extended or adjusted under 35 U.S.C. 154(b) by 327 days.

(21) Appl. No.: 16/189,068

(22) Filed: Nov. 13, 2018

(65) Prior Publication Data

US 2020/0152067 A1 May 14, 2020

(51) Int. Cl.
*G08G 1/00* (2006.01)
*G07C 5/08* (2006.01)
*G07C 5/00* (2006.01)

(52) U.S. Cl.
CPC ..... *G08G 1/20* (2013.01); *G07C 5/008* (2013.01); *G07C 5/0808* (2013.01)

(58) Field of Classification Search
CPC ..... G08G 1/20; G07C 5/008; G07C 5/0808
See application file for complete search history.

(56) References Cited

U.S. PATENT DOCUMENTS 8,620,714 B2 12/2013 Williams et al.
9,697,491 B2 7/2017 Keaveny et al.
2007/0203637 A1 8/2007 Passman et al.
2010/0057479 A1 3/2010 De et al.
2011/0172873 A1* 7/2011 Szwabowski ..... G06Q 50/30 701/29.5
2013/0164712 A1* 6/2013 Hunt ..... G06F 17/00 434/65
2013/0164715 A1* 6/2013 Hunt ..... G09B 9/052 434/65
2013/0211660 A1* 8/2013 Mitchell ..... G08G 1/127 701/29.3
2015/0178661 A1* 6/2015 Keaveny ..... G07C 5/085 705/7.42
2016/0117928 A1* 4/2016 Hodges ..... G08G 1/0967 701/99
2018/0025430 A1 1/2018 Perl et al.

FOREIGN PATENT DOCUMENTS

CN 1004954690 6/2009

OTHER PUBLICATIONS

Traxroot Fleet—Smart Fleet Management System (https://www.taxroot.com/fleet-management-software), Traxoid Automations Pvt Ltd, 2018, 5 pages (accessed Aug. 7, 2018).

* cited by examiner

*Primary Examiner* — Truc M Do
(74) *Attorney, Agent, or Firm* — Dinsmore & Shohl LLP

(57) ABSTRACT

A method for determining actual wear and tear of fleet cars is provided. The method includes at a cloud server comprising a processor, a memory and a database, receiving, from a first fleet car, first data streams generated by a first group of sensors mounted on the first fleet car, receiving from a second fleet car second data streams generated by a second group of sensors mounted on the second fleet car, and determining, with the processor, actual wear and tear of the first fleet car and the second fleet car based on the first wear and tear element and the second wear and tear element.

15 Claims, 5 Drawing Sheets

SYSTEMS AND METHODS FOR DETERMINING ACTUAL OPERATING CONDITIONS OF FLEET CARS

TECHNICAL FIELD

Embodiments described herein generally relate to systems and methods for determining actual operating conditions of fleet cars, and, more specifically, to systems and methods for determining actual operating conditions of fleet cars based on a deviation of operating conditions from estimated operating conditions, which may be initiated and impacted by driving patterns and usage patterns of fleet cars. The embodiments described here further relate to systems and methods for managing and maintaining fleet cars based on the actual operating conditions of fleet cars.

BACKGROUND

Fleet carts are used in rental cars services, car sharing services, self-managed fleet cars services such as UPS® services, and trucking services. A central service station manages fleet cars by tracking fleet cars and providing standard maintenance services.

Operating conditions of fleet cars may widely vary. This is because fleet cars may be used by different drivers and are exposed to different usage patterns. For example, a fleet car having been subject to gentle use may require less maintenance than another fleet car having been subject to rough use. If some drivers drive fleet cars by speeding, hard-braking, hard-accelerating, abruptly changing lanes, etc., such fleet cars will likely experience faster and serious wear and tear. In other cases, some drivers may not maintain a fleet car's interior space in a clean condition. As another example, some fleet cars experience long distance driving, even though such cars have been recently put to use as fleet cars. On the other hand, some fleet cars may not be used frequently. Some fleet cars may have been subject to favorable use conditions such as gentle driving, shorter mileage, favorable road conditions, favorable climate conditions, indoor parking, etc.

As the operation conditions of fleet cars may significantly differ, managing fleet cars based on an identical set of rules and/or a preset maintenance protocol may not result in effective management and maintenance of fleet cars. Accordingly, there is a need to provide systems and methods for determining actual operating conditions of fleet cars in light of driving patterns and usage patterns of fleet cars in order to improve fleet cars management and maintenance.

SUMMARY

In one embodiment, a method for determining a deviation of an actual operating condition of a fleet car from a predetermined estimated operating condition of the fleet car is provided. The method includes (i) at a computing system comprising a processor, a memory and a database, receiving, from a selected fleet car, one or more data streams generated by a group of sensors mounted on the selected fleet car, (ii) identifying one or more drivers of the selected fleet car, (iii) analyzing, with the processor, the one or more data streams and determining a first group of parameters and a second group of parameters, wherein the first group of parameters is indicative of one or more driving patterns of the one or more drivers and the second group of parameters is indicative of an actual wear and tear state of the selected fleet car, (iv) computing, with the processor, a driver score based on the first group of parameters, (v) determining, with the processor, the actual wear and tear state based on the second group of parameters, (vi) retrieving from the database, with the processor, a predetermined estimated condition and a predetermined maintenance schedule associated with the selected fleet car, (vii) determining, with the processor, a deviation of an actual operating condition of the selected fleet car from the predetermined estimated condition of the selected fleet car.

In another embodiment, a method for determining actual wear and tear of fleet cars is provided. The method includes (i) at a cloud server comprising a processor, a memory and a database, receiving, from a first fleet car, first data streams generated by a first group of sensors mounted on the first fleet car, (ii) receiving from a second fleet car second data streams generated by a second group of sensors mounted on the second fleet car, (iii) identifying one or more drivers of the first fleet car and the second fleet car, (iv) analyzing, with the processor, the first data streams and the second data streams, (v) determining, with the processor, first wear and tear element initiated by driving patterns of the drivers in the first and the second fleet cars, (vi) determining, with the processor, second wear and tear element caused by usage patterns of the first and the second fleet cars, and (vii) determining, with the processor, actual wear and tear of the first fleet car and the second fleet car based on the first wear and tear element and the second wear and tear element.

In another embodiment, a system for determining a deviation of an actual operating condition of fleet cars from a predetermined estimated operating condition of fleet cars is provided. The system includes one or more processors, a database coupled to the one or more processors, a communication interface configured to exchange data streams with a plurality of vehicles, one or more memory communicatively coupled to the one or more processors, and machine readable instructions stored in the one or more memory and upon execution by the one or more processors. The machine readable instructions perform at least (i) identifying one or more drivers of the selected fleet car, (ii) analyzing, with the processor, the one or more data streams and determining a first group of parameters and a second group of parameters, wherein the first group of parameters is indicative of one or more driving patterns of the one or more drivers and the second group of parameters is indicative of an actual wear and tear state of the selected fleet car, (iii) computing, with the processor, a driver score based on the first group of parameters, (iv) determining, with the processor, the actual wear and tear state based on the second group of parameters, (v) retrieving from the database, with the processor, a predetermined estimated condition and a predetermined maintenance schedule associated with the selected fleet car, and (vi) determining, with the processor, a deviation of an actual operating condition of the selected fleet car from the predetermined estimated condition of the selected fleet car.

In another embodiment, a system for determining actual wear and tear of fleet cars includes a processor, a database coupled to the processor, a communication interface configured to exchange data streams with a plurality of vehicles, and a memory coupled to the processor and storing machine readable instructions. The machine readable instructions, upon execution by the processor, perform at least (i) receiving, from a first fleet car, first data streams generated by a first group of sensors mounted on the first fleet car; (ii) receiving from a second fleet car second data streams generated by a second group of sensors mounted on the second fleet car; (iii) identifying one or more drivers of the first fleet car and the second fleet car; (iv) analyzing, with the processor, the first data streams and the second data streams; (v) determining, with the processor, a first wear and tear element initiated by driving patterns of the drivers in the first and the second fleet cars; (vi) determining, with the processor, a second wear and tear element caused by usage patterns of the first and the second fleet cars, and (viii) determining, with the processor, actual wear and tear of the first fleet car and the second fleet car based on the first wear and tear element and the second wear and tear element.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Figure 1:
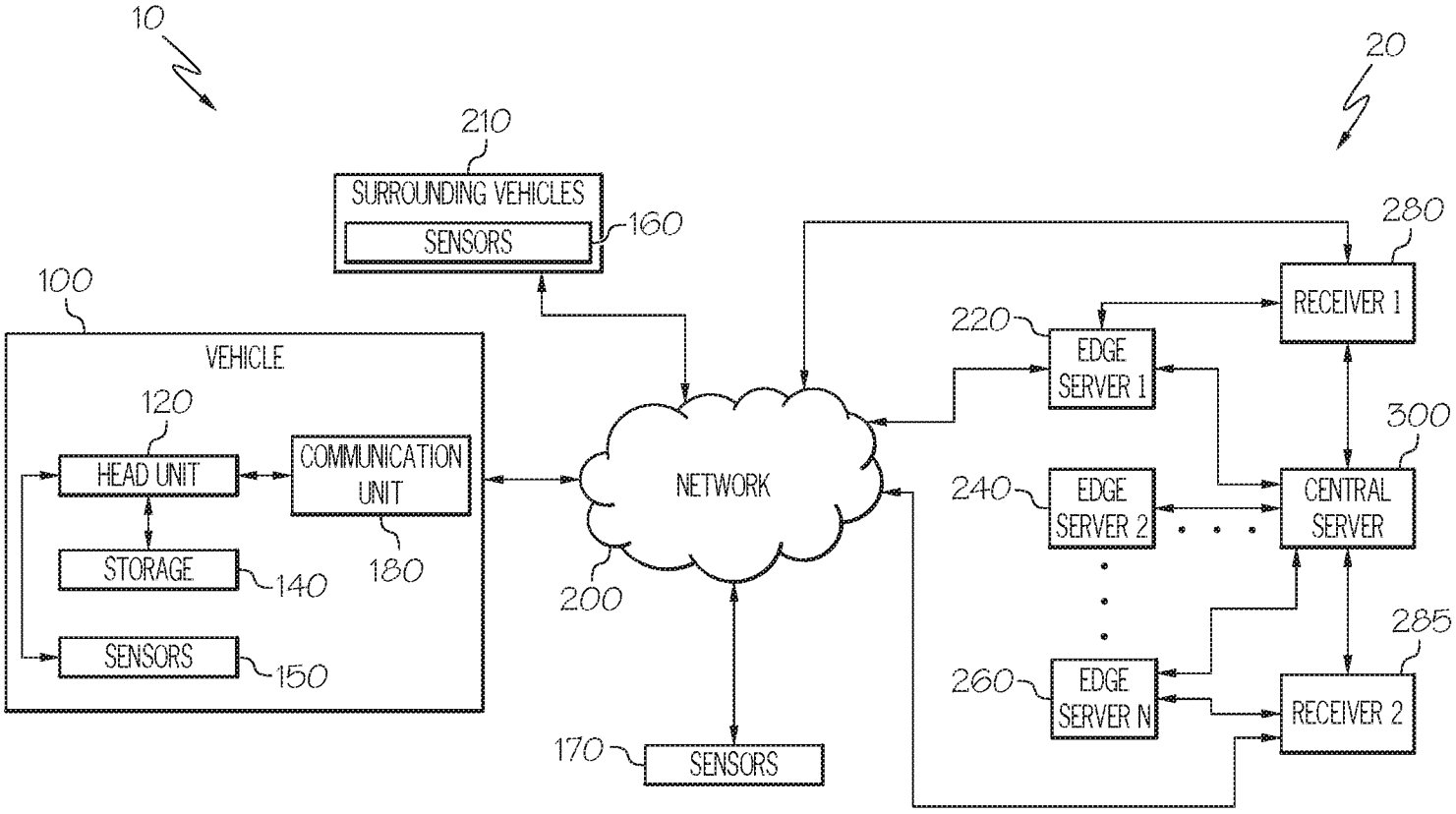
FIG. 1 schematically depicts a connected car system according to one or more embodiments shown and described herein.

Connected cars are equipped to communicate with other devices, utilizing connectivity available via wireless and/or cellular networks. Connected cars may be connected to and communicate with the surroundings. Connected cars may communicate via a variety of communication models, including Vehicle to Infrastructure ("V2I"), Vehicle to Vehicle ("V2V"), Vehicle to Cloud ("V2C"), and Vehicle to Everything ("V2X") communication models, A V2I communication model facilitates the communication between a vehicle and one or more infrastructure devices, which may enable the exchange of data generated by a vehicle and information about the infrastructure. A V2V communication model facilitates the communication between vehicles and may allow for the exchange of data generated by surrounding vehicles, including speed and position information of surrounding vehicles. A V2C communication model facilitates the exchange of information between a vehicle and a cloud system. A V2X communication model interconnects all types of vehicles and infrastructure systems with another.

As discussed above, connected cars operate to capture and generate a large amount of data about a vehicle, surrounding vehicles, the environment, etc. Connected cars seamlessly transmit such data to surrounding vehicles, a cloud server, other infrastructure, etc. and communicate with them via the network. The embodiments disclosed herein include systems and methods for maintaining fleet cars using composite factors indicative of actual operating conditions of fleet cars. In some embodiments, the composite factors include usage patterns and driving patterns of fleet cars. Fleet cars disclosed herein may include connected cars. Although there may be differences in terms of the degree of functionality implemented with fleet cars, the network connectivity may be provided to the extent that data will be exchanged between fleet cars and a remote server such as a cloud server. The cloud server may operate as a fleet car maintenance and management service. The operation conditions of fleet cars may be obtained and determined based on data from onboard sensors and other sensors and transmitted using the network connectivity to the cloud server.

Systems and methods for determining actual operating conditions of fleet cars are described. The systems and methods analyze driving patterns and usage patterns of fleet cars and determine actual operating conditions of fleet cars. More specifically, the systems and methods determine a deviation of operating conditions of fleet cars from estimated operating conditions, which may be predetermined by fleet car manufacturers. The systems and methods include a fleet car computing system, databases relating to drivers and fleet cars, onboard data sensors for providing car data, a predetermined first program that collects data relating to drivers' driving patterns and usage patterns of a fleet car and calculates and assigns a driver score to each driver, and a predetermined second program that adjusts aspects of maintenance of fleet cars based on the car data, the driver score, a predetermined maintenance schedule, maintenance particulars associated with each vehicle, etc.

In the embodiments disclosed herein, the systems and methods may effectively perform management and maintenance of fleet cars by customizing and adjusting maintenance schedules based on the actual operating conditions of fleet cars. The customized management and maintenance of fleet cars enable improved use of maintenance resources and attract customers by providing customers with more incentives. The various systems and methods for maintaining fleet cars will be described in more detail herein with specific reference to the corresponding drawings.

FIG. 1 schematically depicts a connected cars system 10 including a vehicle 100 and a cloud computing system 20. The vehicle 100 includes a head unit 120, storage 140 and various sensors 150. The head unit 120 controls operation of the vehicle 100 based on data points captured and sent from the sensors 150. The storage 140 is coupled to the head unit 120 and stores a set of data points under the control of the head unit 120. The sensors 150 include various types of sensors used in the vehicle 100. In some embodiments, the sensors 150 include one or more cameras, an accelerometer, a proximity sensor, a braking sensor, a motion sensor, etc. However, the sensors 150 used in the vehicle 100 may not be limited thereto and other sensors can be implemented.

In some embodiments, the vehicle 100 also receives data points from other sensors 170 that may be arranged outside of the vehicle 100. For example, the sensors 170 may be arranged on or within buildings such as a parking structure, municipal infrastructure, the surroundings of the vehicle 100, etc. The vehicle 100 may receive data points from the sensors 170 via the network 200. Alternatively, the central server 300 may receive data points from the sensors 170 via the network 200. In other embodiments, the vehicle 100 may receive the data points from surrounding vehicles 210 via a V2V communication channel. Like the sensors 150, various types of sensors such as one or more cameras, an accelerometer, a proximity sensor, a braking sensor, a motion sensor, etc. may be used as the sensors 170.

As shown in FIG. 1, the vehicle 100 includes a communication unit 180 that exchanges data and information between the vehicle 100 and a network 200. As shown in FIG. 1, the vehicle 100 may be connected and communicate with one or more edge servers 220, 240 and 260. The edge servers 220, 240 and 260 may be connected and communicate with a central server 300. The central server 300 may be in communication with receivers 280, 285. Receivers 280 and 285 such as Receiver 1 and Receiver 2 may connect vehicles with the central server 300 as an intermediary.

The central server 300 may represent a cloud server run by a commercial network carrier or another entity (e.g., municipality), to operate as a node. For instance, a particular city may run a cloud server as a node to receive reports relating to road conditions, such as pot holes, from vehicles. The central server 300 may operate as such a node. In some embodiments, edge servers 1, 2 . . . N 220, 240 and 260 may represent such cloud nodes for various purposes run by various entities and the central server 300 may be a server behind those nodes which have some logics to run those nodes and the overall vehicle data offloading systems.

Figure 2:
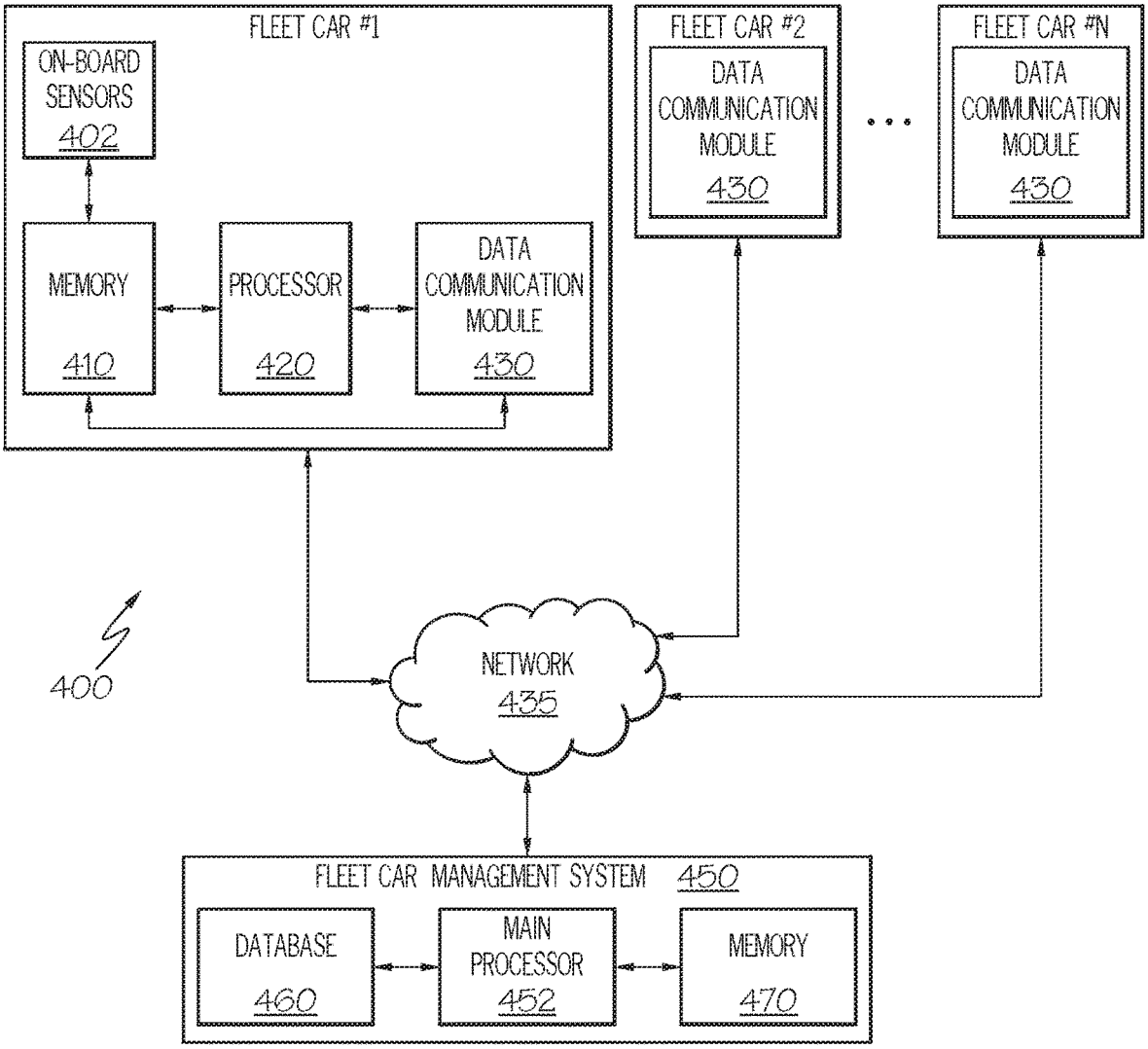
FIG. 2 schematically depicts an overall system configuration including multiple fleet cars and a fleet car management system according to one or more embodiments shown and described herein.

FIG. 2 schematically depicts an overall system configuration 400 including multiple fleet cars and a fleet car management system 450 according to one or more embodiments shown and described herein. FIG. 2 depicts Fleet Car #1, Fleet Car #2, Fleet Car #N, etc. These fleet cars may be used for various services, such as car sharing services, trucking services, delivery service cars, etc. In some embodiments, the fleet cars shown in FIG. 2 may be connected cars as described above in FIG. 1.

As shown in FIG. 2, Fleet Car #1 includes on-board sensors 402, a processor 420 and memory 410. The structures of Fleet Car #2 and Fleet Car #N may be identical or similar to the structure of Fleet Car #1. The on-board sensors 402 includes various sensors used in a vehicle, including but not limited to, a camera, a speed sensor, a brake sensor, a wheel sensor, a steering sensor, a proximity sensor, an accelerometer, a seat buckle sensor, a seat occupancy sensor, etc. The memory 410 stores an operating system and other programs that are relevant to the fleet car management disclosed herein.

In some embodiments, the on-board sensors 402 may include a first group of sensors that detect car data and a second group of sensors that detect occupancy data. The first group of sensors may include, by way of example, an accelerometer, a proximity sensor, a speed sensor, a wheel sensor, a braking sensor, a car rotation sensor, etc. The first group of sensors may generate and provide data points indicative of driving patterns and usage patterns of fleet cars. The second group of sensors may include, by way of example, a camera, a seat occupancy sensor, a biometric sensor, etc. The second group of sensors may be used to identify a driver.

Drivers of Fleet Car #1 may vary. For instance, Fleet Car #1 may be used in a car sharing service. In some embodiments, drivers of Fleet Car #1 may need to register for the car sharing services and reserve Fleet Car #1. In other embodiments, drivers of Fleet Car #1 may be identified from user profiles of drivers captured by Fleet Car 41 through drivers' smartphones, or a computing device of Fleet Car #1. In another embodiment, Fleet Car #1 may include the second group of sensors for identifying drivers through facial recognition, biometric recognition, etc.

Data streams from the on-board sensors 402 are sent to the processor 420 and processed. In some embodiments, Fleet Car 41 transmits the data streams from the on-board sensors 402 as raw data to a cloud server, such as the fleet car management system 450 for processing. In other embodiments, the processor 420 is capable of analyzing the data streams from the on-board sensors to determine driving patterns of drivers and usage patterns of Fleet Car 41. In that case, the memory 410 stores a predetermined set of programs that determines driving patterns and usage patterns of Fleet Car 41. The memory 410 further stores a predetermined program that determines identity of drivers.

As shown in FIG. 2, the fleet car management system 450 is connected to multiple fleet cars over the network 435. The fleet car management system 450 may operate as a central cloud server that collects and processes data from the multiple fleet cars such as Fleet Car #1. The fleet car management system 450 includes a main processor 452, a database 460 and a memory 470. The main processor 452 may have high processing capability that collects, processes and analyzes data streams provided from the multiple fleet cars. The main processor 452 is connected to the memory 470 which stores a predetermined program that processes and analyzes the data streams from the fleet cars. Specifically, the memory 470 may store a program that determines driving patterns and usage patterns of the multiple fleet cars by the same or different drivers, as will be discussed more in detail below. In some embodiments, the memory 470 stores discrete programs that determine driving patterns, usage patterns and driver identification, respectively.

Figure 3:
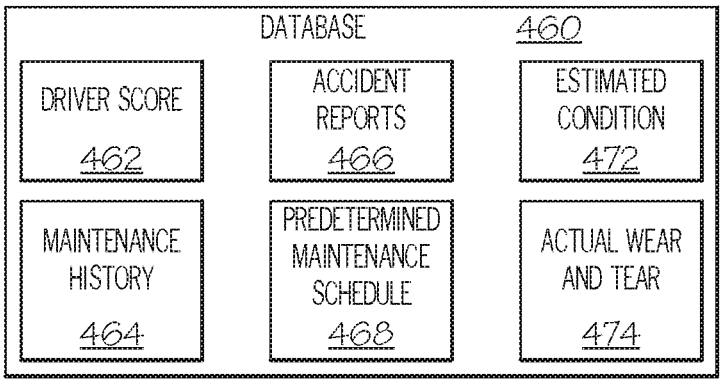
FIG. 3 depicts a block diagram of a database included in the fleet car management system of FIG. 2 according to one or more embodiments shown and described herein.

Referring to FIG. 3, the database 460 of the fleet car management system 450 is described. FIG. 3 depicts a block diagram of the database 460 according to one or more embodiments shown and described herein. The database 460 includes various data sets that may be needed for determining driving patterns and usage patterns of fleet cars such as Fleet Car 41. As shown in FIG. 3, the database 460 includes a driver score 462, maintenance history data 464, accident reports data 466, a predetermined maintenance schedule 468, estimated condition data 472, and actual wear and tear data 474. In other embodiments, the database 460 may include more or less data sets based on need.

The driver score 462 relates to driver scores assigned to drivers who have driven and are using the multiple fleet cars. In some embodiments, driver scores may be in the form of numerical values that are indicative of driving patterns associated with drivers. The driver score 462 may include a driver score of Driver A, for example, which has been collected and aggregated for the situation where Driver A has been a driver of Fleet Car #1. Also, the driver score of Driver A further includes driving patterns resulting from driving of other fleet cars by Driver A. In other words, the driver score of Driver A keeps track of driving by Driver A, regardless of whether Driver A drives Fleet Car #1 or other cars. Alternatively, or additionally, the driver score of Driver A may include a driver score specific to Fleet Car #1, independently of the driver score resulting from driving of other fleet cars by Driver A.

The maintenance history 464 and the accident reports 466 include data relating to historical performance and events that may have bearing or impact on the operating conditions of fleet cars. For instance, accidents that may have resulted in serious damage to a fleet car may likely impact the actual operation condition, even though such fleet car has been in use for a short time. The predetermined maintenance schedule 468 may be determined and provided by fleet car manufacturers as a guideline and/or recommended steps for fleet car maintenance. The predetermined maintenance schedule 468 may be determined based on statistical and historical data relating to average wear and tear of a fleet car and may not reflect the actual operating conditions of fleet cars. The predetermined maintenance schedule may be used as a guideline, or standard to determine maintenance tasks associated with a particular stage of fleet cars.

The estimated condition data 472 include average operating condition of fleet car components based on statistical and historical data. The estimate condition data 472 may serve as a reference or standard that allows the fleet car management system 450 to determine a deviation therefrom. The actual wear and tear data 474 includes actual operating data which may be determined based on raw data from the sensors 150 and 170.

Figure 4:
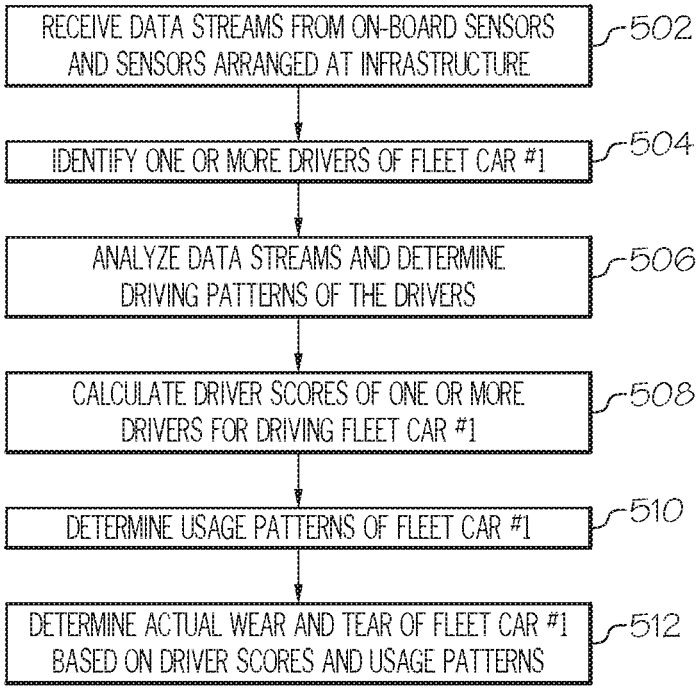
FIG. 4 depicts a flow chart of a method for determining an actual operating condition of a fleet car according to one or more embodiments shown and described herein.

FIG. 4 depicts a flow chart of determining actual operating conditions of a fleet car. In FIG. 4, Fleet Car #1 is used for convenience of explanation. The main processor 452 receives data streams from the on-board sensors of Fleet Car #1, such as the sensors 150. (Step 502). The main processor 452 also receives data streams from infrastructure sensors, such as the sensors 170. In this embodiment, the sensors provide raw data and the vehicle processor may not analyze the data streams from the sensors to determine patterns. Such analysis may take place by the main processor 452 at the cloud server. At step 504, the main processor 452 identifies one or more drivers of Fleet Car #1. For instance, one or more drivers may drive Fleet Car #1 for services such as car sharing services. In this embodiment, Driver Thomas has been registered to use Fleet Car #1 and the main processor 452 identifies Driver Thomas via the registered data stored in the database 460. Alternatively, or additionally, the main processor 452 may receive data streams from the sensors such as a biometric sensor, a camera, etc. and extract the identity of Driver Thomas. In another embodiment, the main processor 452 may receive user profile information of Driver Thomas from Fleet Car #1.

At Step 506, the main processor 452 may analyze data streams and determine driving patterns of the driver (e.g., Driver Thomas). If Driver Thomas performs hard-braking, hard-accelerating, etc., the data generated by the sensors reflect such driving patterns. As shown in FIG. 2, the main processor 452 executes a driver score determination program stored in the memory 420 to perform operations illustrated in FIG. 3. (Step 508). The main processor 452 calculates and determines driver scores of one or more drivers for driving Fleet Car 41, such as a driver score of Driver Thomas. The drivers score determination will be discussed more in detail below in connection with FIG. 5.

The main processor 452 further determines usage patterns of Fleet Car #1. (Step 510). In other embodiments, the usage patterns may be determined first and then the main processor 452 may determine the drivers score. The usage patterns of Fleet Car #1 may be determined based on the sensor data and data available from the database 460 such as accident data, maintenance history, a driver score available, etc. The main processor 452 determines actual wear and tear of Fleet Car #1 based on driver scores and usage patterns. (Step 512). The actual wear and tear of Fleet Car #1 are thus determined based on the actual conditions of Fleet Car #1 and drivers who have driven Fleet Car #1. The actual wear and tear of Fleet Car #1 determined here may reflect the actual operating conditions of Fleet Car #1. The actual wear and tear of Fleet Car #1 also may represent any deviation from an estimated condition of Fleet Car #1 which has been set by manufacturers in light of the elapsed time of Fleet Car #1 since Fleet Car #1 has put to use.

Figure 5:
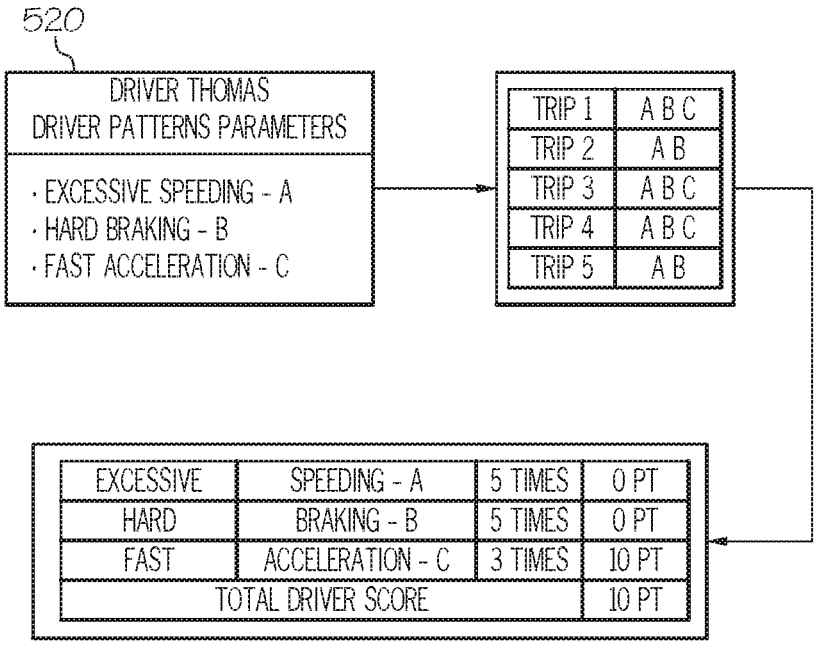
FIG. 5 depicts determination of a driver score as a result of fleet car driving according to one or more embodiments shown and described herein.

Referring to FIG. 5, determination of a driver score as a result of fleet car driving according to one or more embodiments shown and described herein is described. In some embodiments, Driver Thomas has been repeatedly driving Fleet Car #1. Driver Thomas is identified with various means such as one or more driver identification sensors, a registered or reserved use record, a roaming use profile, etc. as discussed above. FIG. 5 depicts three factors or parameters that relate the determination of driving patterns and driver scores. The three factors or parameters include excessive speeding A, hard braking B, and fast acceleration C. These factors are by way of example and other factors or parameters may be added.

FIG. 5 shows that Fleet Car #1 has been used by Driver Thomas five times. In Trip 1, the main processor 452 determines occurrence of all three factors, excessive speeding A, hard braking B, and fast acceleration C, as shown in FIG. 5. Trip 3 and Trip 4 also show occurrence of all three factors, and only two trips, Trip 2 and Trip 5 show occurrence of two factors, excessive speeding A and hard braking B. The main processor 452 determines occurrence of the relevant factors or parameters after each trip is completed. The main processor 452 then aggregates occurrence of the relevant factors or parameters after a predetermined number of trips is completed, such as the five trips shown in FIG. 5.

The main processor 452 proceeds to calculate and determine a driver score for Driver Thomas. As shown in FIG. 5, Driver Thomas has shown excessive speeding and hard braking in each and every trip that has been tracked and counted. This frequency of occurrence of the factors may result in adding no credit or point to a driver score. As the fast acceleration factor has appeared less frequent than the other two factors, a small point may be added to a driver score of Driver Thomas. A total driver score of Driver Thomas as a result of 5 trips and aggregation of a driver score is, for example, 10 points, as shown in FIG. 5. In some embodiments, this level of a driver score may put Driver Thomas in a low driver score category.

In other embodiments, the relevant factors or parameters such as the excessive speeding factor, the hard braking factor, and the fast acceleration factor may be associated with different levels. For instance, the excessive speeding factor may be associated with three levels, high, intermediate and low. By way of example, if a speed limit is 50 mph, speeding between 50 mph to 70 mph may be associated with a low level, speeding between 70 mph and 80 mph associated with an intermediate level, and 80 mph and up associated with a high level. The excessive speeding associated with the high level and a high frequency of occurrence of the high level excessive speeding from multiple trips may result in a much lower driver score. The relevant factors or parameters associated with different levels may enable a more detailed determination of driving patterns by drivers. As road conditions, speed limit, climate conditions, vehicle types, etc. may vary, the relevant factors or parameters may be customized and adjusted in order to be effective in determining the driving patterns of drivers.

In some embodiments, the driver score used in the embodiments herein may be calculated to have predetermined ranges. Like a credit score, a specific range of the driver score may be set to indicate high performing drivers and low performing drivers. In some embodiments, the driver scores may be calculated based on data from the on-board sensors, but the present disclosure is not limited thereto. In other embodiments, a driver's driving history including speeding, any record of improper and illegal driving, and accident information may be used to supplement the data from the on-board sensors.

As discussed above, in some embodiments, a driver score may be aggregated. In one embodiment, the driver score may be aggregated based on drivers. For instance, Driver A drives a fleet car for one trip and a driver score is calculated based on driving data resulting from that first trip. As Driver A drives the same fleet car for additional trips, the driver score is further calculated based on additional driving data resulting from the additional trip. As the driver score reflects more trips for Driver A, accuracy of the driver score, as an indicator of driving patterns of Driver A, may increase.

In another embodiment, the driver score may be aggregated, even though Driver A may drive different fleet cars. For instance, Driver A uses fleet cars available for car sharing services. The identity of Driver A may be recognized as he or she drives a different fleet car, as discussed above. The aggregated driver score in this embodiment may provide different information about Driver A's driving patterns, as different fleet cars are involved, as opposed to the embodiment that Driver A drives the same fleet car. In other embodiments, the aggregated driver score of Driver A for driving different fleet cars may be compared with the aggregated driver score of Driver A for driving the same fleet car in order to determine whether Driver A presents consistent driving manners and patterns, regardless of fleet cars, whether a certain type of fleet cars may affect driving patterns of Driver A, etc.

If Driver A has high driver score indicative of excellent maintenance of Fleet Car #1 and the driving history of Driver A is consistent with the driver score, the central server 450 may determine that Driver A is entitled to an incentive package. In some embodiments, the incentive package may provide lower insurance premiums for using fleet cars. Additionally, the incentive package may include a discount for using car sharing services. Accordingly, Driver A may be motivated and incentivized to use a fleet car more gently and maintain a fleet car in use in a clean condition. As a result, fleet cars subject to good use by drivers will likely require less maintenance and repair and, at the same time, cleaning and significant cost savings in the fleet car management providers.

Figure 6:
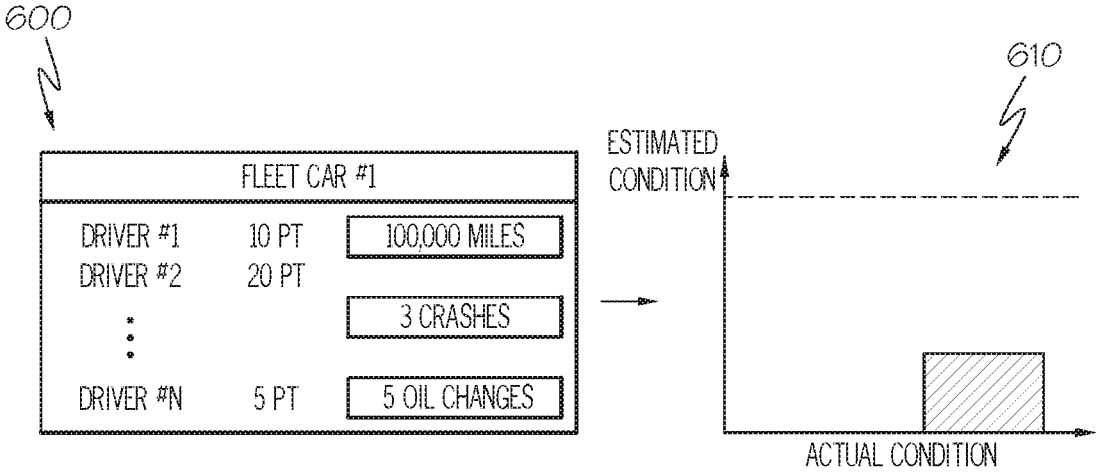
FIG. 6 depicts one example of a deviation of actual operating condition of a fleet car from an estimated operating condition affected by usage patterns and driving patterns.

FIG. 6 depicts one example of a deviation of actual operating condition of a fleet car from an estimated operating condition affected by usage patterns and driving patterns. FIG. 6 depicts a data record 600 of Fleet Car #1 stored in the database 460 of the fleet car management system 450 as shown in FIG. 2. Additionally, the data record 600 may be stored in the memory 410 of Fleet Car #1. As shown in FIG. 6, Fleet Car #1 may have been driven by multiple drivers, such as Driver #1, Driver #2, Driver #N, etc. Each driver has the associated driver score. Using the examples shown in FIG. 6, each driver has a low driver score and belongs to a group of drivers who show driving patterns that may affect the operating condition of Fleet Car #1 unfavorably. In addition, the data record 600 of Fleet Car #1 further shows a relatively high mileage record, 3 crashes and only 5 oil changes, which may be considered as high mileage and less frequent maintenance than recommended by a manufacturer for vehicles having the usage time.

FIG. 6 further depicts a chart 610 comparing the estimated condition and the actual condition of Fleet Car #1. The actual condition of Fleet Car #1 is far below the estimated condition in light of the usage patterns and the driving patterns of Fleet Car 41. The actual condition of Fleet Car #1 may reflect the drivers having driven Fleet Car #1, the accident history, the maintenance history, and the usage history and accurately indicate the actual operating condition of Fleet Car #1. The main processor 452 as shown in FIG. 2 may use the actual condition of Fleet Car 41 in order to determine maintenance and management needed for Fleet Car #1.

Figure 7:
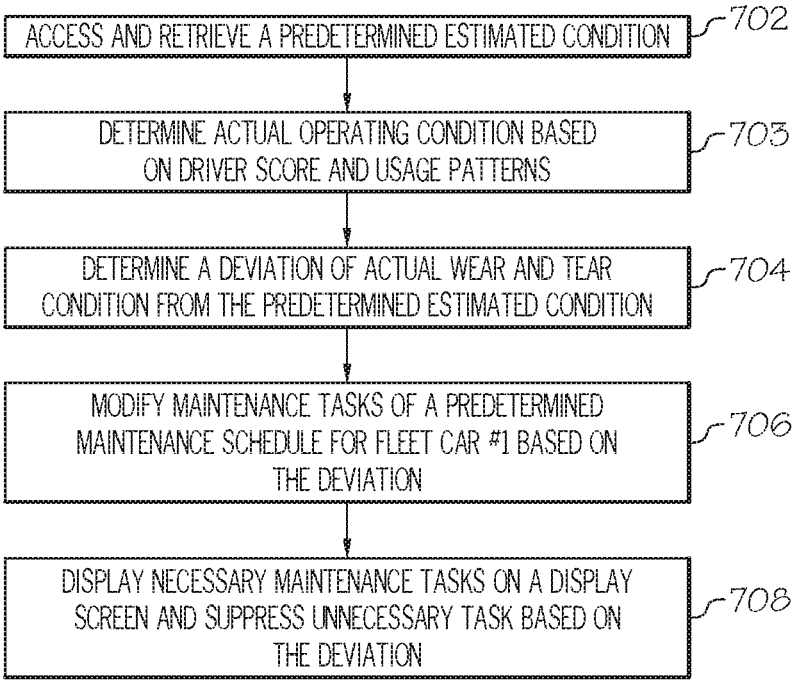
FIG. 7 depicts a flow chart of a method for managing maintenance of fleet cars according to one or more embodiments shown and described herein.

FIG. 7 depicts a flow chart of a method for managing maintenance of fleet cars according to one or more embodiments shown and described herein. The main processor 452 may access and retrieve a predetermined estimated condition. (Step 702). As discussed above in connection with FIG. 3, the database 460 stores the estimated condition data 472. As discussed above, the main processor 452 determines actual operating condition of Fleet Car #1 based on the driver scores and the usage pattern of Fleet Car #1. (Step 703). The main processor 452 then determines a deviation if any of actual wear and tear condition from the predetermined estimated condition. (Step 704).

In some embodiments, such deviation from the predetermined estimated condition may trigger a need to adjust a predetermined maintenance schedule and predetermined maintenance tasks. (Step 706). For instance, if such deviation is determined, then the fleet car management system 420 may set a flag and send out a notification message or a system alert prompting on a display screen, that the predetermined maintenance schedule has been changed. The main processor 420 then may add or remove maintenance tasks to/from the predetermined maintenance schedule. (Step 706). For instance, if the deviation indicates that the actual wear and tear condition of Fleet Car #1 is much less than the estimated condition, reflected by the high driver score and/or infrequency use of Fleet Car #1, then the main processor 420 may remove one or more maintenance tasks from the predetermined maintenance schedule. By way of example, if Fleet Car #1 has been driven far less mileage than the estimated mileage at that point of time, then the main processor may remove oil change set based on the passage of time.

Additionally, or alternatively, the fleet car management system 420 may request a user input with respect to any change to the predetermined maintenance schedule. A user may include a skilled and experienced mechanic who is aware of the meaning of the deviation and tasks to be added or removed. Furthermore, a user may add or remove customized maintenance tasks if the predetermined maintenance tasks do not reflect such customized tasks.

As one example, if a driver score and car data indicate mild use and infrequent driving, the second program adjusts oil change service to take place after a longer time period of use than a regular oil change schedule. In addition, a driver score may be used to determine preferred pricing for a good driver, which provides incentives to a driver and may result in cost saving and more revenue for fleet car management. Additionally, or alternatively, drivers may be incentivized to perform better driving and keeping fleet cars in good conditions by offering lower insurance rates based on the driver score.

Figure 8:
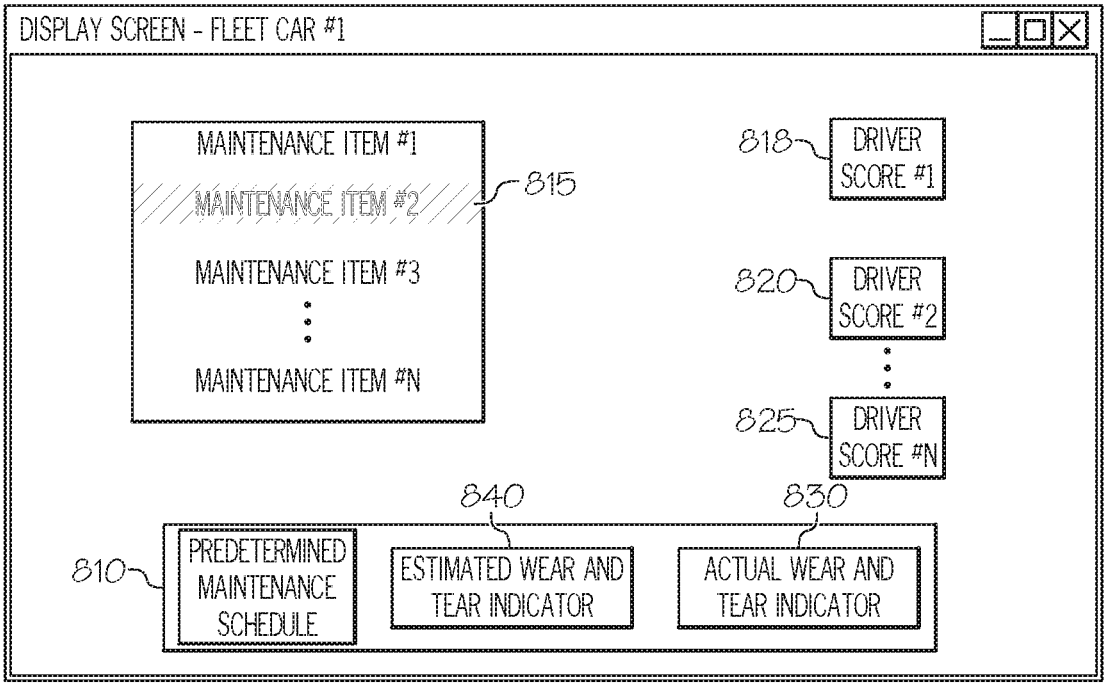
FIG. 8 depicts one example of a user interface displaying maintenance tasks of a fleet car maintenance system according to one or more embodiments shown and described herein.

FIG. 8 depicts one example of a user interface displaying maintenance tasks of a fleet car maintenance system 450 according to one or more embodiments shown and described herein. As shown in FIG. 8, the display screen of Fleet Car

#1 displays a list of maintenance tasks 815, driver scores 818, 820 and 825 of drivers associated with Fleet Car #1, links or taps to a predetermined maintenance schedule 810, an estimated wear and tear indicator 840, and an actual wear and tear indicator 830. A user of the fleet car maintenance system 450 may have access to the driver sores 818, 820 and 825 and the list of maintenance tasks 815.

FIG. 8 further depicts that some maintenance tasks are deactivated or suppressed on the display screen. In particular, FIG. 8 shows that maintenance item #2 has been deactivated in light of the usage pattern and the driving scores relating to Fleet Car #1. A user of the fleet car management system 450 may check the actual wear and tear condition of Fleet Car #1 by using the links or taps 830 which appears on the display screen. Accordingly, the fleet car management system 450 may provide a convenient and easy to use user interface for checking and evaluating the maintenance tasks associated with Fleet Car #1.

In other embodiments, the display screen of Fleet Car #1 as shown in FIG. 8 may display the structure of Fleet Car #1 that visually indicates maintenance tasks and associated components. For instance, if an engine of Fleet Car 41 is visually displayed with a visual indicator with a link to specific maintenance tasks. If the link is activated, then detailed maintenance tasks relating to the engine are further displayed. A display of some maintenance tasks are deactivated or suppressed because the actual operation condition may not require such tasks in light of the driving and the usage patterns of Fleet Car #1. Such display is deactivated with a link which leads to explanation, upon clicking the link.

In the embodiments discussed above, the driver score is calculated to determine the actual operating condition of fleet cars. For instance, the aggregated driver score of Driver A is very high and indicates that Driver A drives a fleet car very gently. Once the driver score of Driver A is established, then a maintenance schedule of a selected fleet car to be assigned to Driver A and primarily driven by Driver A will be adjusted. In some embodiments, the maintenance schedule may be adjusted to take place for a longer term than an average time frame. For instance, if oil change of a fleet car is typically scheduled to be every three months, or 3,000 miles, the oil change schedule of the fleet car driven by Driver A may be set to be every five months or at a higher mileage.

On the other hand, if the driver score of Driver A is low, then the maintenance of the fleet car driven by Driver A may follow the regular schedule, or a shorter schedule than the regular schedule. In some embodiments, the driver score of Driver A may not only indicate a general trend of driving patterns of Driver A but also indicate particular parts or components affected by such driving patterns. Even if the driver score of Driver A may be relatively high or average, the driver score may indicate that the driving patterns of Driver A may result in more wear and tear of a brake, for example. Then the maintenance schedule of the fleet car driven by Driver A may be adjusted to selectively check and repair the brake shorter than the regular maintenance schedule and leave other parts subject to the longer maintenance schedule than the regular maintenance schedule.

The driver score may be used to incentivize drivers to use fleet cars gently and in a clean condition. For instance, if the driver score is high, then drivers may get lower insurance package and/or lower service fee for using a fleet car.

Along with the driver score, operating conditions of fleet cars may have a significant impact on maintenance and management of fleet cars. In some embodiments, the data points may be collected after one trip is completed. Once each trip is completed, another set of data points is collected and may be aggregated with the previous data points. In some embodiments, certain criteria may be applied to determine how long the data points should be aggregated, such as twenty repeated trips, or a three month time frame, etc. In some embodiments, these criteria may be set in consideration of a routine maintenance schedule of fleet cars. In other embodiments, these criteria may be set based on historical maintenance patterns, statistical data showing fleet cars maintenance and repair patterns, etc.

Based on the operating conditions of the fleet car, one or more aspects of maintenance of fleet cars may be adjusted. Other factors such as the driver score can be also considered in addition to the operating conditions of the fleet car, as a combination.

In some embodiments, a program that calculates the driver score of the driving patterns of Driver A may be stored in the memory of the fleet car management system. The driver score program stored in the memory calculates the driver score once a trip is completed. When Driver A repeats trips, the driver score program further calculates the driver score subsequent to each trip and aggregate the driver scores. When Driver A uses different fleet cars through car sharing, or is assigned with different fleet cars for delivery services, etc., the remote server may be able to keep track of the data relating to the driving patterns of Driver A and determine and update the driver score of Driver A.

The memory further stores a program that determines the operation conditions of fleet cars. In some embodiments, the program that calculates the operating conditions of fleet cars may be stored in the memory. The operating conditions program stored in the memory calculates the operating conditions once a trip is completed. When fleet cars repeat trips, the operating conditions program further calculates the operating conditions subsequent to each trip and aggregate the data relating to the operating conditions.

The fleet car management system may keep track of the operation conditions of fleet cars, while being driven by different drivers. Accordingly, the fleet car management system may be able to associate fleet cars with different drivers. In some embodiments, the fleet car management system may aggregate the driver score and/or the operating conditions in order to update the resulting driver score and/or the operating conditions and improve accuracy.

In some embodiments, the memory of the fleet car management system stores a fleet car maintenance program. The fleet car maintenance program determines wear and tear of various parts of fleet cars after the trip is completed based on the operating conditions of fleet cars. In some embodiments, Driver A may have been associated with a particular driver score based on past trips. The fleet car maintenance program then access the driver score of Driver A which may be stored in the memory. Then the fleet car maintenance program factors the driver score of Driver A into the determination of wear and tear.

In some embodiments, the fleet car maintenance program makes the determination of wear and tear after a predetermined time frame has elapsed, or after a predetermined number of trips is completed. The fleet car maintenance program then associates the determination with the driver score of Driver A and a routine maintenance schedule assigned to fleet cars. For example, the routine maintenance schedule may be prepared and distributed by a manufacturer of fleet cars.

In some embodiments, the driver score of Driver A may indicate gentle use of fleet cars and the operating conditions of fleet cars correspond to average level. Even if the routine maintenance schedule may indicate that maintenance is due as to a specific part, the fleet car maintenance program may determine that maintenance may take place later than the routine maintenance schedule. In other embodiments, the driver score of Driver A may indicate rough use of fleet cars and the operating conditions of fleet cars corresponds to serious wear and tear. Then the fleet car maintenance program may determine that maintenance may take place earlier than the routine maintenance schedule.

In some embodiments, fleet cars are used in car shaming services and a large number of drivers drive a large number of fleet cars. The car sharing services may include many different models and makers of fleet cars. In that case, the fleet car maintenance program may determine the maintenance timing and need in consideration of a specific driver and operating conditions of a specific fleet car, rather than solely relying on a routine maintenance schedule distributed for a particular type of fleet cars.

In the embodiments described above, a method for determining a deviation of an actual operating condition of fleet cars from a predetermined estimated operating condition of fleet cars is provided. The method includes (i) at a cloud server comprising a processor, a memory and a database, receiving, from a selected fleet car, one or more data streams generated by a group of sensors mounted on the selected fleet car, (ii) identifying one or more drivers of the selected fleet car, (iii) analyzing, with the processor, the one or more data streams and determining a first group of parameters and a second group of parameters, wherein the first group of parameters is indicative of one or more driving patterns of the one or more drivers and the second group of parameters is indicative of an actual wear and tear state of the selected fleet car, (iv) computing, with the processor, a driver score based on the first group of parameters, (v) determining, with the processor, the actual wear and tear state based on the second group of parameters, (vi) retrieving from the database, with the processor, a predetermined estimated condition and a predetermined maintenance schedule associated with the selected fleet car, (vii) determining, with the processor, a deviation of an actual operating condition of the selected fleet car from the predetermined estimated condition of the selected fleet car.

In another embodiment, the method for determining the deviation further comprises based on the deviation from the predetermined estimated condition, modifying predetermined maintenance tasks associated with the predetermined maintenance schedule, and suppressing a display of a first group of maintenance tasks on a display screen and adding a second group of maintenance tasks on the display screen.

In another embodiment, the step of determining the first group of parameters includes determining whether the one or more data streams indicate occurrence of excessive speeding, determining a frequency of occurrence of excessive speeding, and determining a road condition and geo location at the time of excessive speeding. In another embodiment, the step of determining the first group of parameters includes determining whether the one or more data streams indicate occurrence of hard braking, and determining a frequency of occurrence of hard braking. In yet another embodiment, the step of determining the first group of parameters includes determining whether the one or more data streams indicate occurrence of fast acceleration, and determining a frequency of occurrence of fast acceleration.

In another embodiment, the method for determining the deviation further comprises accessing and retrieving from the memory one or more related driver scores of the identified drivers associated with driving of other fleet cars, aggregating the driver score associated with driving of the selected fleet car with the related driver scores, correlating the deviation of the selected fleet car with an aggregated driver score, and storing the correlation information in storage. In yet another embodiment, the step of computing the driver score further includes (i) determining a frequency of occurrence of the first group of parameters after a first trip is completed, (ii) aggregating the frequency of occurrence of the first group of parameters after a predetermined number of trips is repeated, and (iii) assigning the driver score proportional to a total frequency of occurrence of the first group of parameters.

In another embodiment, the method for determining the deviation further includes (i) accessing and retrieving from the memory usage history and an accident report of the selected fleet car, and (ii) determining, with the processor, the actual wear and tear state based on the second group of parameters, the usage history, the accident report and the driver score. In yet another embodiment, the method for determining the deviation further includes (i) determining whether the driver score of a selected driver exceeds a predetermined upper threshold, and (ii) upon determination that the driver score of a selected driver exceeds a predetermined upper threshold, transmitting a notification alerting incentives proportional to the driver score.

In another embodiment, a method for determining actual wear and tear of fleet cars is provided. The method includes (i) at a cloud server comprising a processor, a memory and a database, receiving, from a first fleet car, first data streams generated by a first group of sensors mounted on the first fleet car, (ii) receiving from a second fleet car second data streams generated by a second group of sensors mounted on the second fleet car, (iii) identifying one or more drivers of the first fleet car and the second fleet car, (iv) analyzing, with the processor, the first data streams and the second data streams, (v) determining, with the processor, first wear and tear element initiated by driving patterns of the drivers in the first and the second fleet cars, (vi) determining, with the processor, second wear and tear element caused by usage patterns of the first and the second fleet cars, (vii) determining, with the processor, actual wear and tear of the first fleet car and the second fleet car based on the first wear and tear element and the second wear and tear element. In yet another embodiment, the method for determining actual wear and tear of fleet cars further includes displaying maintenance tasks on the first fleet car according to a predetermined maintenance schedule for the first fleet car, and displaying maintenance tasks on the second fleet car deviated from the predetermined maintenance schedule for the second fleet car.

In another embodiment, the step of determining the first wear and tear element further includes detecting excessive speeding, hard braking, fast acceleration, or a combination thereof. In another embodiment, the step of determining the first wear and tear element further includes determining a frequency of occurrence of excessive speeding, a frequency of occurrence of hard braking, a frequency of occurrence of fast acceleration, or a combination thereof. In yet another embodiment, the step of determining the first wear and tear element further includes determining a frequency of occurrence of one or more of occurrence of excessive speeding, hard braking and fast acceleration during a predetermined number of trips.

In another embodiment, the step of determining the second wear and tear element further includes determining a total hours of driving, one or more accidents, maintenance history of one or more components, or a combination thereof. In yet another embodiment, the step of displaying maintenance tasks on the second fleet car further includes suppressing one or more of maintenance tasks required in the predetermined maintenance schedule.

In another embodiment, a system for determining a deviation of an actual operating condition of fleet cars from a predetermined estimated operating condition of fleet cars is provided. The system includes one or more processors, a database coupled to the one or more processors, a communication interface configured to exchange data streams with a plurality of vehicles, one or more memory communicatively coupled to the one or more processors, and machine readable instructions stored in the one or more memory and upon execution by the one or more processors. The machine readable instructions perform at least (i) identifying one or more drivers of the selected fleet car, (ii) analyzing, with the processor, the one or more data streams and determining a first group of parameters and a second group of parameters, wherein the first group of parameters is indicative of one or more driving patterns of the one or more drivers and the second group of parameters is indicative of an actual wear and tear state of the selected fleet car, (iii) computing, with the processor, a driver score based on the first group of parameters, (iv) determining, with the processor, the actual wear and tear state based on the second group of parameters, (v) retrieving from the database, with the processor, a predetermined estimated condition and a predetermined maintenance schedule associated with the selected fleet car, (vi) determining, with the processor, a deviation of an actual operating condition of the selected fleet car from the predetermined estimated condition of the selected fleet car. In yet another embodiment, the machine readable instructions further perform based on the deviation from the predetermined estimated condition, modifying predetermined maintenance tasks associated with the predetermined maintenance schedule, and controlling a display screen to suppress a display of a first group of maintenance tasks and to add a second group of maintenance tasks on the display screen.

In another embodiment, the machine readable instructions further perform (i) determining whether the one or more data streams indicate occurrence of excessive speeding, (ii) determining a frequency of occurrence of excessive speeding, and (iii) determining a road condition and geo location at the time of excessive speeding. In yet another embodiment, the machine readable instructions further perform determining whether the one or more data streams indicate occurrence of hard braking, and determining a frequency of occurrence of hard braking. In another embodiment, the machine readable instructions further perform determining whether the one or more data streams indicate occurrence of fast acceleration, and determining a frequency of occurrence of fast acceleration.

In another embodiment, the machine readable instructions, upon execution by the one or more processors, further perform at least (i) accessing and retrieving from the memory one or more related driver scores of the identified drivers associated with driving of other fleet cars, (ii) aggregating the driver score associated with driving of the selected fleet car with the related driver scores, (iii) correlating the deviation of the selected fleet car with an aggregated driver score, and (iv) storing the correlation information in storage. In yet another embodiment, the machine readable instructions further perform (i) determining a frequency of occurrence of the first group of parameters after a first trip is completed, (ii) determining the frequency of occurrence of the first group of parameters after a predetermined number of trips is repeated, and (iii) assigning the driver score proportional to a total frequency of occurrence of the first group of parameters. In yet another embodiment, the machine readable instructions, upon execution by the one or more processors, further perform at least (i) accessing and retrieving from the memory usage history and an accident report of the selected fleet car, and (ii) determining, with the processor, the actual wear and tear state based on the second group of parameters, the usage history, the accident report and the driver score.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method comprising:

receiving, from a selected fleet car, one or more data streams generated by a group of sensors mounted on the selected fleet car;

analyzing the one or more data streams and determining a first group of parameters and a second group of parameters, wherein the first group of parameters is indicative of one or more driving patterns of a plurality of drivers of the selected fleet car and the second group of parameters is indicative of an actual wear and tear state of the selected fleet car;

computing a driver score for each of the plurality of drivers based on the first group of parameters of the selected fleet car and a first group of parameters of another fleet car associated with a same driver of the plurality of drivers;

determining the actual wear and tear state based on the second group of parameters;

retrieving from a database, with a processor, a predetermined estimated condition and a predetermined maintenance schedule associated with the selected fleet car; and determining a deviation of an actual operating condition of the selected fleet car from the predetermined estimated condition of the selected fleet car, wherein the actual operating condition is determined based on the first group of parameters, the second group of parameters, and the driver score for each of the plurality of drivers.

2. The method of claim 1, wherein the step of determining the first group of parameters comprises:

determining whether the one or more data streams indicate occurrence of excessive speeding;

determining a frequency of occurrence of excessive speeding; and determining a road condition and geo location at the time of excessive speeding.

3. The method of claim 1, wherein the step of determining the first group of parameters comprises:

determining whether the one or more data streams indicate occurrence of hard braking; and determining a frequency of occurrence of hard braking.

4. The method of claim 1, wherein the step of determining the first group of parameters comprises:

determining whether the one or more data streams indicate occurrence of fast acceleration; and determining a frequency of occurrence of fast acceleration.

5. The method of claim 1, further comprising:

based on the deviation from the predetermined estimated condition, modifying predetermined maintenance tasks associated with the predetermined maintenance schedule; and suppressing a display of a first group of maintenance tasks on a display screen and adding a second group of maintenance tasks on the display screen.

6. The method of claim 1, further comprising:

accessing and retrieving from a memory one or more related driver scores of the identified drivers associated with driving of other fleet cars;

aggregating the driver score associated with driving of the selected fleet car with the related driver scores;

correlating the deviation of the selected fleet car with an aggregated driver score; and storing the correlation information in storage.

7. The method of claim 1, wherein the step of computing the driver score further comprises:

determining a frequency of occurrence of the first group of parameters after a first trip is completed;

aggregating the frequency of occurrence of the first group of parameters after a predetermined number of trips is repeated; and assigning the driver score proportional to a total frequency of occurrence of the first group of parameters.

8. The method of claim 1, further comprising:

accessing and retrieving from a memory usage history and an accident report of the selected fleet car; and determining, with the processor, the actual wear and tear state based on the second group of parameters, the usage history, the accident report and the driver score.

9. The method of claim 1, further comprising:

determining whether the driver score of a selected driver exceeds a predetermined upper threshold; and upon determination that the driver score of a selected driver exceeds a predetermined upper threshold, transmitting a notification alerting incentives proportional to the driver score.

10. A system comprising:

machine readable instructions stored in one or more memory and upon execution by one or more processors, performing at least the following:

identifying a plurality of drivers of a selected fleet car;

analyzing one or more data streams and determining a first group of parameters and a second group of parameters, wherein the first group of parameters is indicative of one or more driving patterns of the one or more drivers and the second group of parameters is indicative of an actual wear and tear state of the selected fleet car;

computing a driver score for each of the plurality of drivers based on the first group of parameters of the selected fleet car and a first group of parameters of another fleet car associated with a same driver of the plurality of drivers;

determining the actual wear and tear state based on the second group of parameters;

retrieving from a database a predetermined estimated condition and a predetermined maintenance schedule associated with the selected fleet car; and determining, with the processor, a deviation of an actual operating condition of the selected fleet car from the predetermined estimated condition of the selected fleet car, wherein the actual operating condition is determined based on the first group of parameters, the second group of parameters, and the driver score for each of the plurality of drivers.

11. The system of claim 10, wherein the machine readable instructions stored in the one or more memory and upon execution by the one or more processors, further perform at least the following:

based on the deviation from the predetermined estimated condition, modifying predetermined maintenance tasks associated with the predetermined maintenance schedule; and controlling a display screen to suppress a display of a first group of maintenance tasks and to add a second group of maintenance tasks on the display screen.

12. The system of claim 10, wherein determining the first group of parameters further comprises:

determining whether the one or more data streams indicate occurrence of excessive speeding;

determining a frequency of occurrence of excessive speeding; and determining a road condition and geo location at the time of excessive speeding.

13. The system of claim 10, wherein determining the first group of parameters further comprises:

determining whether the one or more data streams indicate occurrence of hard braking; and determining a frequency of occurrence of hard braking.

14. The system of claim 10, wherein determining the first group of parameters further comprises:

determining whether the one or more data streams indicate occurrence of fast acceleration; and determining a frequency of occurrence of fast acceleration.

15. The system of claim 10, wherein the machine readable instructions, upon execution by the one or more processors, further perform at least the following:

accessing and retrieving from the memory one or more related driver scores of the identified drivers associated with driving of other fleet cars;

aggregating the driver score associated with driving of the selected fleet car with the related driver scores;

correlating the deviation of the selected fleet car with an aggregated driver score; and storing the correlation information in storage.

* * * * *